US005839481A

United States Patent [19]

Bassi et al.

[11] Patent Number: 5,839,481

[45] Date of Patent: Nov. 24, 1998

[54] PROCEDURE AND A SELECTOR DEVICE OF THE MOVABLE HOOKS OF A SHED-FORMING MECHANISM AND A JACQUARD TYPE LOOM FORCE BALANCING OF HOOKS IN A JACQUARD LOOM

[75] Inventors: Dario Bassi, Chaponnay; Jean-Paul Froment, Doussard, both of France

[73] Assignee: Staubli Lyon, Chassieu, France

[21] Appl. No.: 903,301

[22] Filed: Jul. 30, 1997

[30] Foreign Application Priority Data

Aug. 6, 1996 [FR] France ..... 96 10083

[51] Int. Cl.[6] ..... D03C 3/20

[52] U.S. Cl. ..... 139/455; 139/65

[58] Field of Search ..... 139/455, 65

[56] References Cited

U.S. PATENT DOCUMENTS 4,702,286 10/1987 Palau et al. .

4,739,806 4/1988 Palau et al. ..... 139/455

5,309,952 5/1994 Speich ..... 139/455

5,373,871 12/1994 Speich ..... 139/455

FOREIGN PATENT DOCUMENTS 2587045 3/1987 France .

3524569 1/1987 Germany .

3724686 2/1989 Germany .

*Primary Examiner*—Andy Falik

*Attorney, Agent, or Firm*—Dowell & Dowell, P.C.

[57] ABSTRACT

A procedure for the selection of the moveable hooks of a shed-forming mechanism (7) of a Jacquard type loom comprising at least one catch (9) displaced by a knife (10) between an upper dead point position, in which, or in the proximity of which, the hook may be immobilized by a selector device (15, 16), and a lower dead point position, characterized by exerting on the hook, either in its upper dead point position or in its proximity, a force tending to bring the hook to its lower dead point position. The device comprises elastic stops (20–23) for the hook (9) in its upper dead point position.

10 Claims, 6 Drawing Sheets

PROCEDURE AND A SELECTOR DEVICE OF THE MOVABLE HOOKS OF A SHED-FORMING MECHANISM AND A JACQUARD TYPE LOOM FORCE BALANCING OF HOOKS IN A JACQUARD LOOM

BACKGROUND OF THE INVENTION

1. Field of the Invention

This invention relates to a procedure and a selector device for the moveable hooks of a mechanism for the formation of the shed on a Jacquard type loom and to a Jacquard type loom comprising such a device.

2. History of the Related Art

In the Jacquard type looms, a shed-forming mechanism selectively raises the heddles that are provided with an eyelet through which passes the warp yarn. The warp is positioned with respect to a hook that is provided at the top of the heddle either above or underneath of the weft yarn moved by the loom.

By way of example, from European patent EP-0 214 975 it is known that a hook of such a shed-forming mechanism is displaced by a slay or knife between an upper dead point position, in the proximity of which the hook may be immobilized by a selector device corresponding to a positioning of the warp yarn above the weft yarn, and a lower dead point position that corresponds to the position of the warp yarn underneath the weft yarn. By way of the selector device a lever moves between two positions in which it either blocks the hook in its position or it does not impede the movement of the hook of the shed-forming mechanism. By way of example, this lever is controlled by an electromagnet.

A levelling of the selector levers can be effected with this type of mechanism, namely, the design can be such that, at the time of each alternate movement, a hook located in the proximity of the upper dead point of its path displaces a lower extremity of a corresponding selector lever in such a manner that an upper extremity of the lever is pressed against an electromagnet. This generates a force that impedes the movement of the moveable hook in the proximity of the upper dead point of its path; this holding force is due to frictional forces applied to the hook and to the inertia of the parts in movement.

In order to overcome this force one must constrain the harness formed by the heddles of the Jacquard loom in such a manner that it can exercise on the hooks a downward vertical stress or force roughly equal to the above-mentioned holding or frictional forces. This additional constraint on the harness is added to the regular constraint that is absorbed by the tension of the warp yarns, the frictional force of the guides against the stationary parts of the loom and the inertia of the guides and of the heddles.

The mechanical properties of the harness must be designed in such a manner as to allow the application of this additional downward vertical force, which increases the prime cost, as well as that of the harness' mechanical compensating devices and, in a more generalized manner, of the mechanical drive elements that must be oversized. Such design, however, would increase the wear and tear on the mechanical assembly of the Jacquard loom and of the harness. Besides, the necessary forces to overcome the friction forces are susceptible to generating vibrations in the loom, which vibrations may have unfavorable effects on the operation and on the useful life of the moveable elements of the loom.

SUMMARY OF THE INVENTION

The chief object of the present invention is that of solving these problems and to provide a process and a selector device for the moveable hooks of a loom that will allow an optimization of the dimensioning of the harness and of the mechanical drive elements or of elastic compensation, all of which by maintaining the efficiency of a selector device with levelling.

With this in mind, the present invention relates to a process of selecting the moveable hooks of a shed-forming mechanism of a Jacquard type loom comprising at least one hook displaced by a knife between an upper dead point position in which, or in the proximity of which, the hook can be immobilized by a selector device, and a lower dead point position, characterized by the fact that it consists in applying a stress or force on this hook, either in its upper dead point position or in its proximity, tending to bring the hook to its lower dead point position.

Because of the invention, the thus applied forces offset the frictional and inertia forces and it is no longer necessary for the harness to exercise a sufficient force on the moveable hooks to overcome such forces, all of which allows one to simplify and to make easier the design of the loom and of the harness.

In practice, the stress or force applied to the hook is selected in such a manner that it is roughly equal to the resultant of the frictional forces applied by its surroundings to the hook and of the inertia forces. Thus, this force roughly offsets the forces that work against the change of direction of the hook at the upper dead point of its path.

The invention also relates to a device that allows the implementation of the process according to the invention and, more specifically, a selector device for the moveable hooks of a mechanism for the shed-formation on a Jacquard type loom and to a Jacquard type loom comprising at least one hook displaced by a slay or knife between an upper dead point position, in which, or in the proximity of which, the hook can be immobilized by a selector device, and a lower dead point position, characterized by the fact that the hook is provided with elastic stops at its upper dead point, which stops are suitable to apply a force upon the hooks that tends to urge the hook toward its lower dead point position.

Thus, the device according to the present invention makes it possible to abate, to a great extent, the effect of the frictional and inertia forces applied to the hook when it is in its upper dead point position or in its proximity. Furthermore, the forces applied by the elastic stop offsets the inertia of the hook itself. In other words, the force applied by the elastic stop directly applies upon the hook the necessary force to put it into a downward motion starting from the upper dead point of its path.

According to a first advantageous aspect of the invention, the device is comprised of two hooks alternatively displaced by two slays or knives actuated in a reciprocating motion in opposition to the phase, the elastic stops being suitable to interact with the two hooks. Thus, only one elastic stop may serve for two hooks, which enables the device of the invention to retain its simple features.

According to another advantageous aspect of the present invention, the design can be such that the elastic stops comprise a lever suitable to be moved against a spring force by the hook when it reaches its upper dead point position. In accordance with the invention, the force applied on the hook in its upper dead point position, or in its proximity is, in this case, due to the elastic force of the spring.

According to a first particularly advantageous embodiment of the present invention, when the device comprises two hooks alternatively displaced by two knives, measures can be taken to the effect that a lever or stop is moved by the hooks when they reach their respective upper dead point positions.

According to another embodiment of the invention, the elastic stops can comprise a tension spring. This tension spring may be in direct contact with the hooks of the shed-forming mechanism, which allows to obtain, at a very low cost, the sought function.

Lastly, the invention relates to a Jacquard type loom comprising a selector device as described above.

BRIEF DESCRIPTION OF THE INVENTION

The invention will be better understood and some of its other advantages will be more clearly understood in light of the below description of two embodiments of a selector device of the heddles of a Jacquard type loom pursuant to its principle, given solely by way of example and referenced in the hereto attached drawings wherein.

DESCRIPTION OF THE PREFERRED EMBODIMENT

Figure 1:
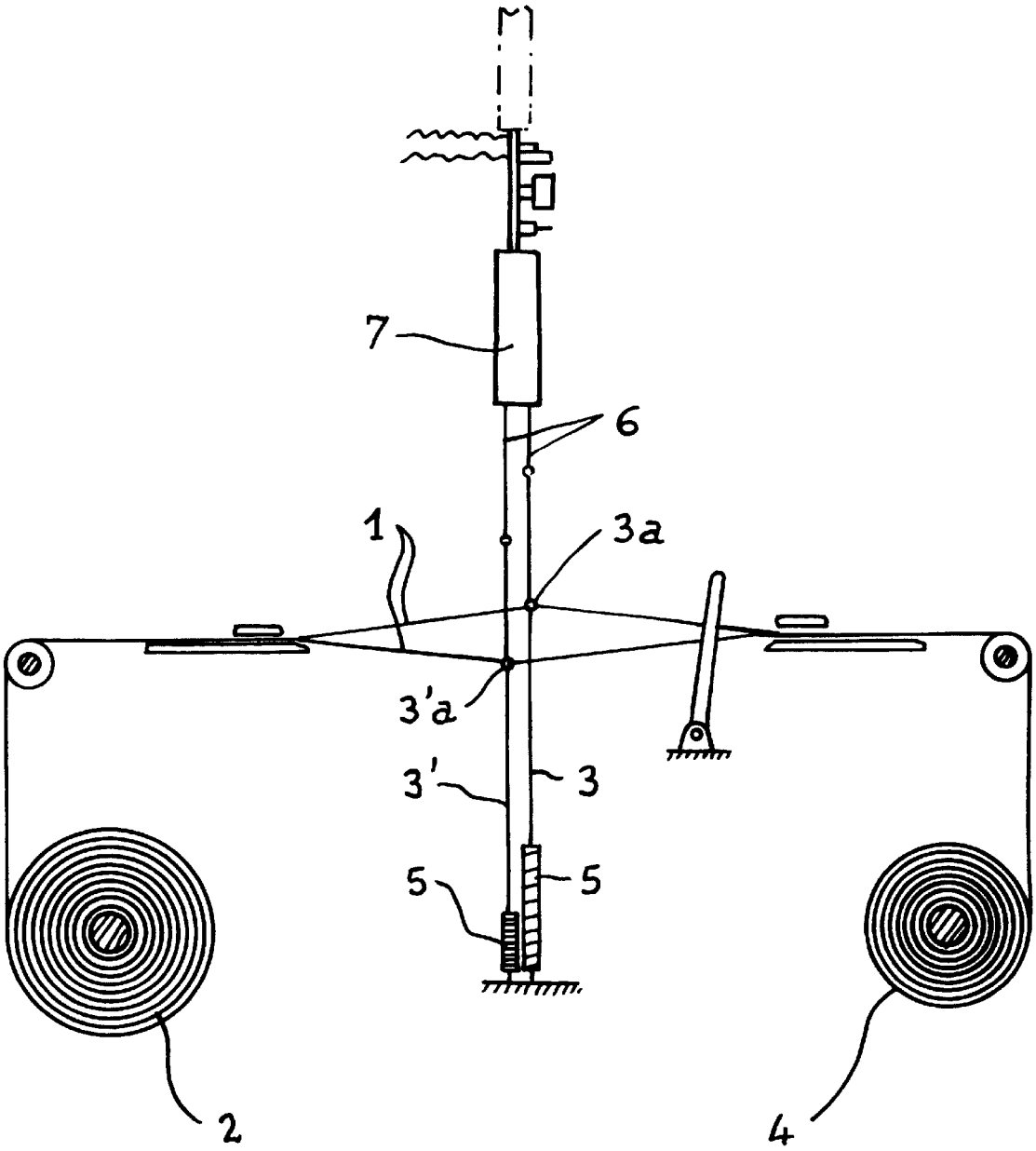
FIG. 1 shows in principle in a diagrammatic form a Jacquard type loom incorporating the invention and intended for the control of two heddles.

In the loom shown in FIG. 1, a warp yarn 1 is delivered by a warp beam 2. Each warp yarn passes trough a eyelet 3*a* of a heddle 3 in order to open the thread to allow the passage of a thread to form the fabric that rolls up around a winding beam or drum. In the example shown, it is assumed that there are only two heddles 3 or two groups of heddles, one in an upper position and the other in a lower position. It is thus that reference number 3' designates the heddles in the lower position and reference number 3 those in the upper position. The lower extremity of each heddle is connected to the frame of the loom by a tension spring 5, while the upper extremity is firmly attached to a guide 6. The guides are raised and lowered by means of a shed-forming mechanism 7.

Figure 2:
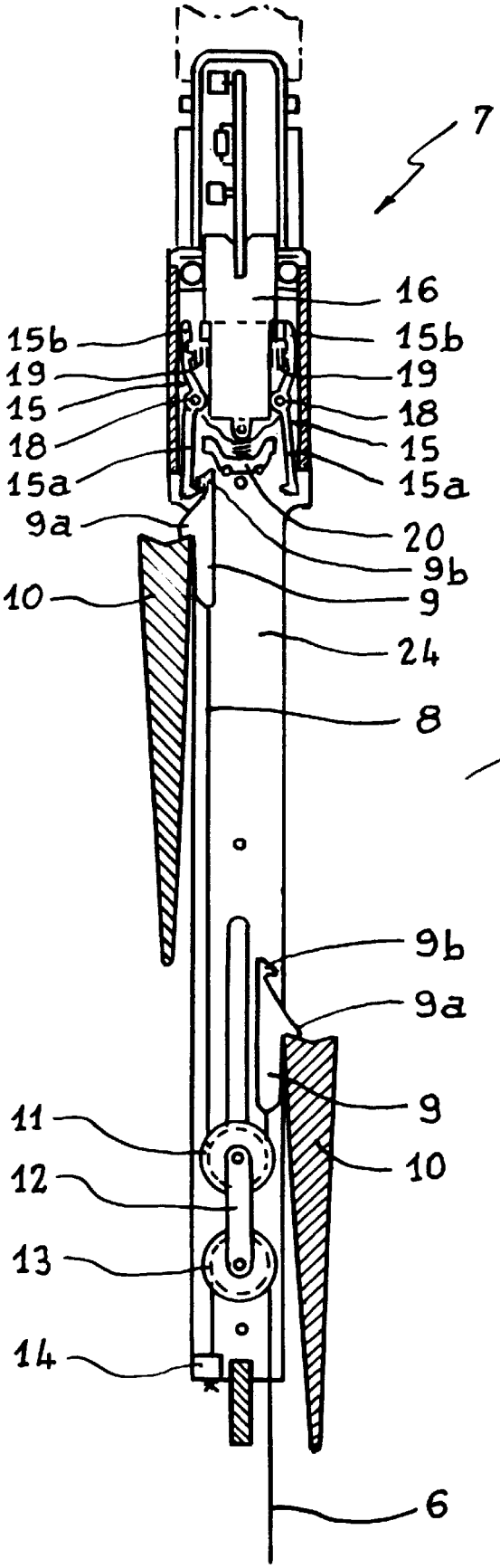
FIG. 2 shows on a larger scale the shed-forming device used with the loom of FIG. 1.

As can be seen more clearly in FIG. 2, the shed-forming mechanism comprises a funicular element 8 of which each of its ends is provided with a catch or hook 9. The hooks comprise a lateral lip 9*a* which interacts with slays or knives 10 actuated in a reciprocating motion in opposition to one another. The funicular element 8 passes around a first pulley 11 of a cross piece 12 which has a second pulley 13 which is encircled by one of the guides 6. The opposite extremity of the guide that is connected to the heddle 3 is anchored at a fixed point 14 of the frame of the machine. The upper part of the mechanism 7 is provided with retaining catches or pivotable hooks designed in the form of levers 15 and being part of a selector device. The levers 15 are connected to an electromagnet 16 in such manner that, when the electromagnet is engaged, the levers are moved towards the center and retained against the electromagnet 16 after they have been moved by a hook 9. The curved ends of the lower arms 15*a* of the levers 15 interact with the upper curved ends 9*b* of the hooks 9 so as to immobilize the hooks in their upper dead point position or in its proximity, as is represented by the hook to the left in FIG. 2, while the hook to the right is represented in the lower dead point position.

Figure 3:
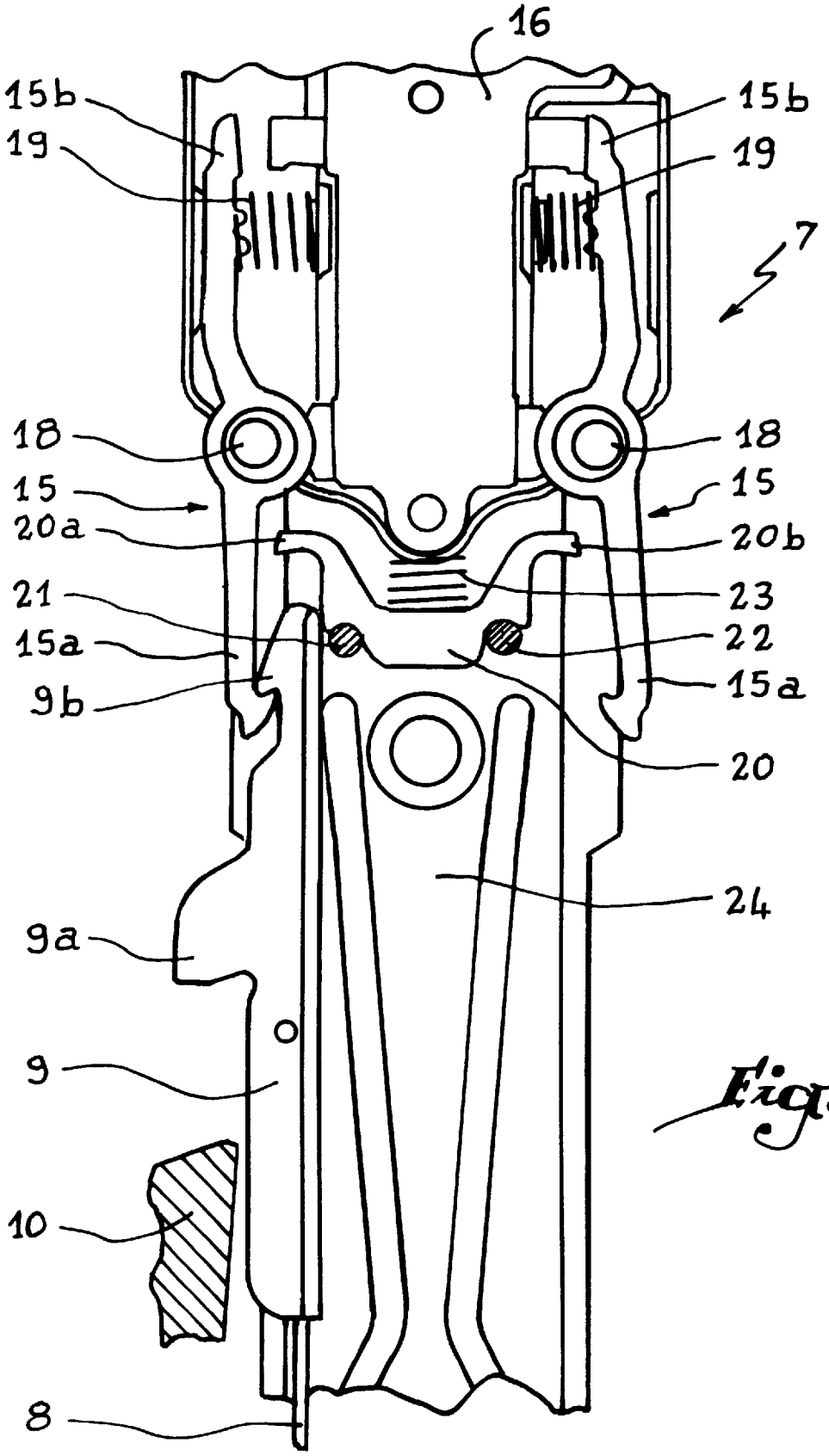
FIG. 3 shows on a larger scale a closeup view of the heddle selector device of the shed-forming device of FIG. 2 in a first working position.

As can be seen more clearly in FIG. 3, each lever 15 is hinged around a pin 18 and comprises a lower arm 15*a* adapted to interact with the upper lip 9*b* of a hook 9 and an upper arm 15*b* adapted to be moved or kept in its position because of the electromagnetic force generated by the electromagnet 16. The upper arm 15*b* of each lever 15 is kept at a distance from the electromagnet 16 by a spring 19 that is compressed when the upper lip 9*b* of the hook 9 displaces the lower extremity of the arm 15*a* of the lever 15 when the hook 9 reaches its upper dead point position.

In the position of FIG. 3, the hook 9 is immobilized in its position because it cannot descend again under the effect of the traction applied to it by the funicular element 8 due to the blocking effected by the lever 15 under the effect of the spring 19. Every time the knife 10 reaches the upper dead point of its path, the hook 9 is slightly raised so that its upper lip 9*b* is released from the arm 15*a* of the lever 15. If at this moment the electromagnet 16 is activated, the arm 15*a* is kept at a distance from the lip 9*b* and it does not impede the downward movement of the lip 9*b* resting on the knife 10. On the contrary, if the electromagnet 16 is not activated, the spring 19 pushes the lever 15 back to its interlocked position with the lip 9*b*. Thus, the hook 9 remains immobilized as long as the electromagnet 16 is not activated.

Figure 4:
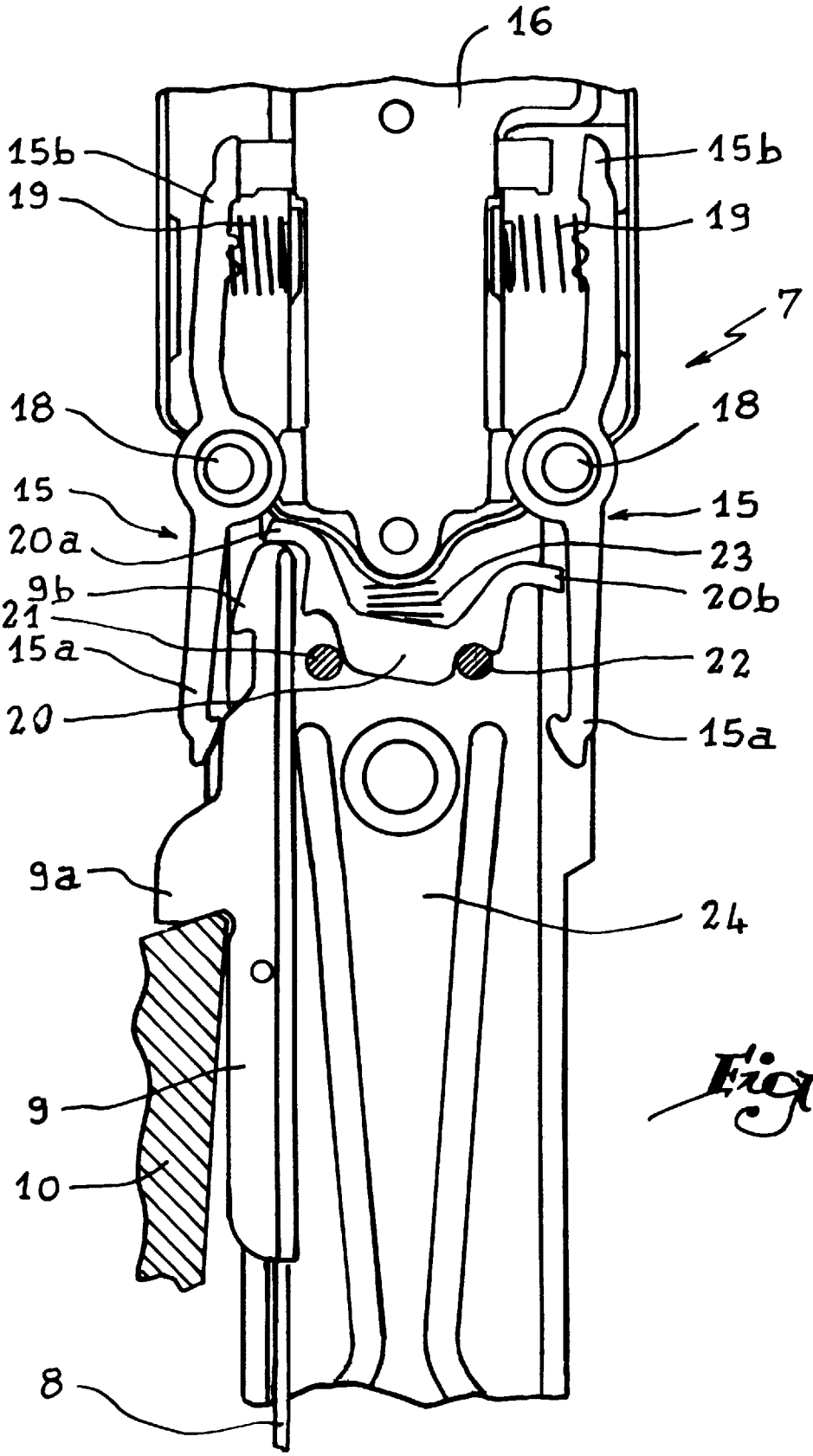
FIG. 4 shows a view analogous to that of FIG. 3, the device being in a second working position.

From FIG. 4 it is shown more clearly that the upper dead point position of the hook 9 is located above the upper dead point position of FIG. 3. In fact, the knife 10 pushes the hook 9 upwards in order to release the lip 9*b* with respect to the extremity of the arm 15*a* of the lever 15. In its position shown in FIG. 3, the hook 9 is in contact with a stop 20 constituted by a curved lever provided with two extensions 20*a* and 20*b* suitable to rest against the hooks 9 when they are in their upper dead point position or in its proximity. The stop 20 rests on two axles 21 and 22 fixed with respect to the housing of the shed-forming mechanism 7. The lever or stop 20 is supported on the axles 21 and 22 by a spring 23 provided above the stop 20, that is to say, on the opposite side of the one to the axles 21 and 22. The movement of the knife 10 moves the stop 20 against the force of the spring 23 towards the position represented in FIG. 4. Thus, the stop 20 constitutes an elastic stop for the movement of the hook 9.

Figure 5:
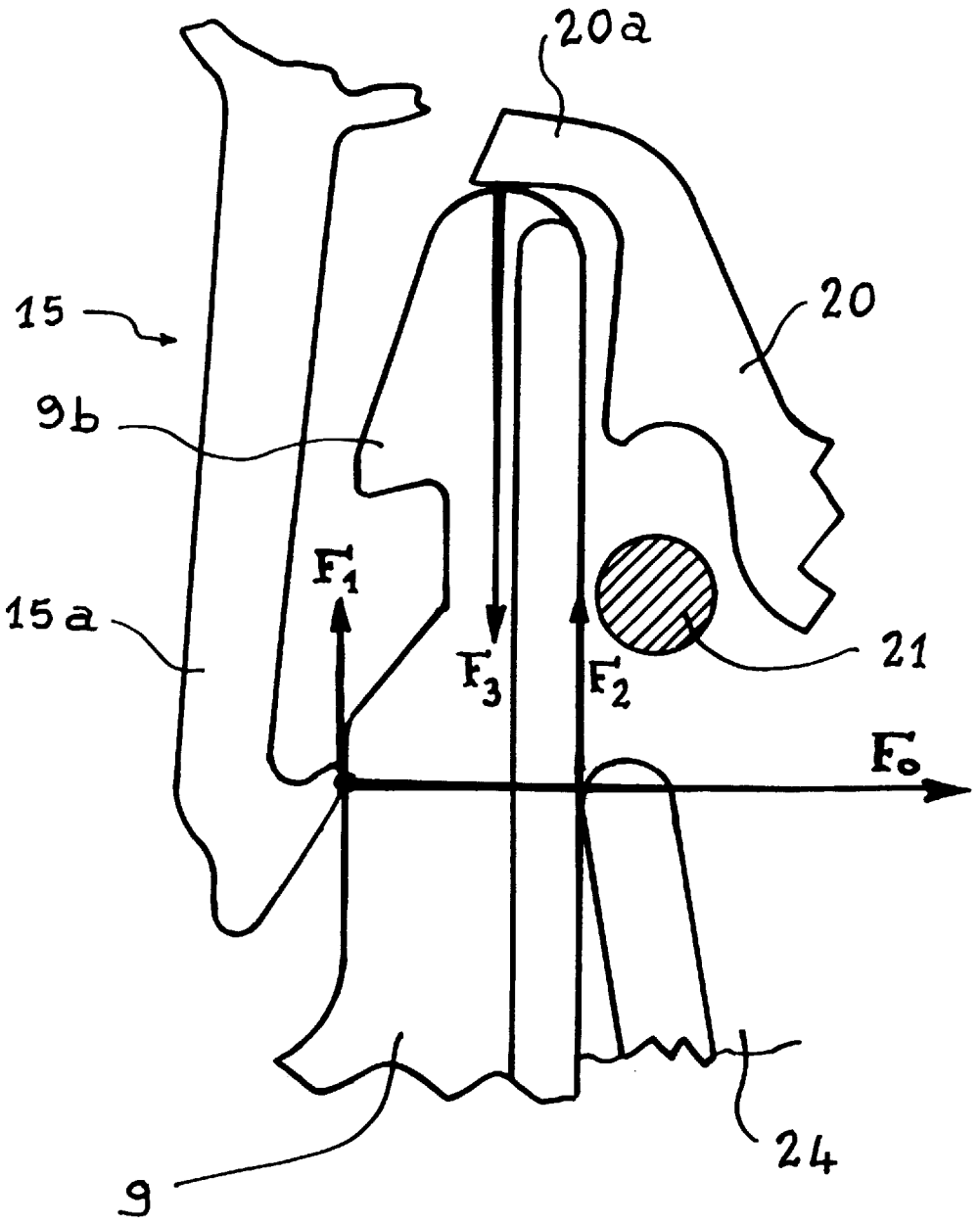
FIG. 5 shows on a larger scale a diagram of the distribution of the forces acting against the hook in the position of FIG. 4.

In its position of FIG. 4, and such as illustrated in FIG. 5, the hook 9 is subjected to a horizontal force $F_0$ by the portion of the lower arm 15*a* of the lever 15; this force is due, among others, to the stress generated by the spring 19. When it commences its downward motion supported on the knife 10, the hook 9 is subjected to a friction force $F_1$ by the arm 15*a* and also to an upward friction force $F_2$, due to its frictional engagement against a guide rail 24 which is part of the structure of mechanism 7.

The forces $F_1$ and $F_2$ are roughly proportional to the force $F_0$. Furthermore, an inertia force proportional to the mass of the hook 9 impedes its downward movement. On the other hand, because of the invention, the hook 9 is subjected to a force $F_3$ exerted by the extremity 20*a* of the stop 20 due to the compression of the spring 23. Taking into account the position of the stop 20, the force $F_3$ is applied to the hook 9 only when it is in the proximity of the upper dead point of its path, so that the movement of the hook is not changed by the presence of the stop 20 on the main part of its path.

Through a judicious selection of the force of the spring 23 within reach of the experts, it is possible to design a device in which the force $F_3$ is roughly equal to the resultant of the frictional forces $F_1$ and $F_2$ and of the inertia forces, which allows that this resultant be annulled.

Thus, the funicular element 8 no longer exerts a stress or force on the hook 9 when it starts on its downwards path. In other words, the guide 6 will no longer exert such a force; this is due to the fact that the spring 5, shown in FIG. 1, can be dimensioned only to absorb the forces due to the tension of the warp yarn, the frictions against the stationary parts of the loom, and the inertia of the guides and of the heddles and no longer to pull down the hook 9. The drive components of the mechanism can be dimensioned to resist minor stresses or forces and the vibrations generated by this device with respect to prior methods are lower.

According to an advantageous aspect of the present invention, the stop 20 may serve as elastic stop for the two hooks 9, which allows that the device maintains its simplicity guaranteeing low cost.

From FIG. 4 it is shown that the stop 20 is displaced by the hook 9 and that it pivots around the axle 22. In the same manner, when the stop is displaced by the hook located to the right in FIG. 2, it pivots around the axle 21.

Figure 6:
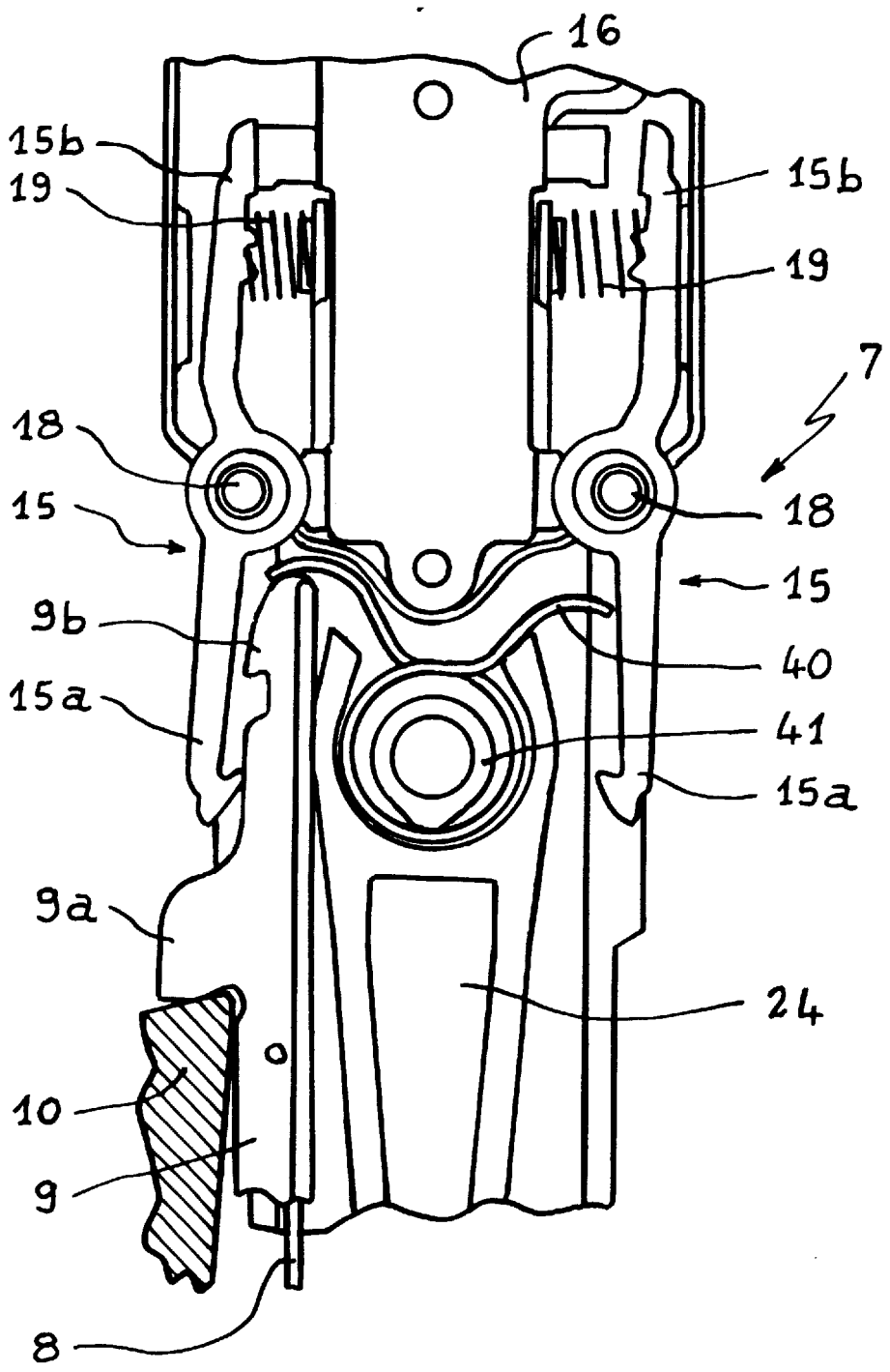
FIG. 6 shows a view analogous to that of FIG. 4 of a selector device in accordance with a second embodiment of the invention.

The device shown in FIG. 6 is a variation of the invention in which the stop is replaced with a tension spring 40 whose central part encircles an axle 41 affixed to the frame of the mechanism 7. The operation is similar to the one described for the device of FIGS. 1 to 4, and the spring 40 is suitable to exert on the hooks 9 a downward forces when they reach their upper dead point positions. Because of its simplicity of design, this variation has the advantage of being particularly inexpensive.

According to an aspect of the present invention that can be implemented in the two described embodiments, when the selector device comprises a multiplicity of modular-arranged hooks, for example, 8 times 2 hooks, being these hooks are suitable to be selected by several heald shafts arranged side by side, the design can be such that the stop 20 or the spring 40 is common to all the hooks of one module and can interact with each of them.

It is conceivable that the invention is also applicable to a shed-forming mechanism in which the retaining levers are not hinged but in which the moveable hooks are blocked in position by stationary elements.

According to a not represented variative of the invention, it is also possible to provide that the elastic stops are mounted on the moveable hooks themselves.

The invention does also relate to a loom comprising a selector device such as described above.

What we claim is:

1. A device for the selection of moveable hooks of a shed-forming mechanism of a Jacquard type loom, comprising; at least one hook displaced by a knife between an upper dead point position wherein said hook may be immobilized by a selector device and a lower dead point position, and elastic stop means which engages said at least one hook in a vicinity of said upper dead point position, said stop means exerting on said at least one hook a force ($F_3$) tending to push said at least one hook towards the lower dead point position.

2. A selector device in accordance with claim 1, including first and second hooks connected by a funicular element, said first and second hooks reciprocally displaced by two knives actuated by alternative reciprocating motions, said elastic stop means engaging said first and second hooks when said first and second hooks are in their top vicinity of their dead point position.

3. A selector device in accordance with claim 2, wherein said elastic stop means includes a lever moveable by said first and second hooks when said hooks reach the vicinity of their upper dead point position.

4. A selector device in accordance with claim 3, wherein said lever is resiliently urged by a spring element against two spaced axles about which said lever can rock when engaged by one of said first and second hooks.

5. A selector device in accordance with claim 1, wherein said elastic stop means includes a lever which is displaced against a force of a spring by said at least one hook when said at least one hook reaches said upper dead point position.

6. A selector device in accordance with claim 1, wherein said elastic stop means includes a tension spring.

7. A selector device in accordance with claim 1, including a multiplicity of first and second hooks that are arranged in side-by-side relationship in a module, said elastic stop means being engageable with each of said multiplicity of first and second hooks of said module.

8. In a Jacquard loom including a shed-forming mechanism which has at least one hook which is displaced by a knife between an upper dead point position and a lower dead point position, and wherein the at least one hook may be selectively immobilized in the vicinity of the upper dead point position by a selector means, the improvement comprising, elastic stop means, said elastic stop means engaging said at least one hook when in the vicinity of said upper dead point position, and said stop means exerting on said at least one hook a force ($F_3$) urging said at least one hook towards the lower dead point position.

9. A method of reducing stress on a hook associated with a shed-forming mechanism of a Jacquard loom to initiate a downward movement of the hook toward a lower dead point position from a vicinity of a top dead point position wherein the hook is acted upon by a first frictional force ($F_1$) caused by frictional engagement of a portion of a lever associated with a selector device against the hook, a second friction force ($F_2$) caused by frictional engagement of the hook with a guide rail, and forces of inertia which are approximately proportional to the mass of the hook, the method including the step of applying a force ($F_3$) on the hook only when the hook is in the vicinity of the top dead point position to urge the hook toward the lower dead point position.

10. The method of claim 9 wherein the step of applying the force ($F_3$) includes applying the force ($F_3$) so as to substantially equal the resultant of the frictional first and second forces ($F_1$ and $F_2$) and the forces of inertia.

* * * * *